United States Patent [19]

Forbes, Jr.

[11] Patent Number: 4,763,832

[45] Date of Patent: Aug. 16, 1988

[54] CARTON WITH BOTTOM LOCK

[75] Inventor: Hampton E. Forbes, Jr., Newark, Del.

[73] Assignee: Westvaco Corporation, New York, N.Y.

[21] Appl. No.: 146,476

[22] Filed: Jan. 21, 1988

[51] Int. Cl.[4] ..... B65D 5/28; B65D 5/42

[52] U.S. Cl. ..... 229/114; 229/145; 229/146; 229/149; 229/152; 229/902

[58] Field of Search ..... 229/141, 145, 146, 149, 229/151-154, 160.1, 164, 902, 906; 229/113, 114

[56] References Cited

U.S. PATENT DOCUMENTS

| | | | |
|---|---|---|---|
| 3,899,119 | 8/1975 | Roccaforte | 229/149 |
| 3,968,922 | 7/1976 | Ruud | 229/146 |
| 4,232,816 | 11/1980 | Johnson et al. | 229/146 |
| 4,289,491 | 9/1981 | Callura et al. | 229/146 |
| 4,339,068 | 7/1982 | Brauner | 229/145 |
| 4,360,147 | 11/1982 | Brauner | 229/146 |
| 4,428,525 | 1/1984 | Brauner | 229/146 |
| 4,570,845 | 2/1986 | Hall | 229/146 |

FOREIGN PATENT DOCUMENTS

| | | | |
|---|---|---|---|
| 2581033 | 10/1986 | France | 229/153 |
| 1569002 | 6/1980 | United Kingdom | 229/145 |

*Primary Examiner*—Stephen Marcus
*Assistant Examiner*—Gary E. Elkins

[57] ABSTRACT

A carton for food products or the like comprises a combination lid and tray with a bottom locking means for securing the lid and tray when the carton is closed. The bottom locking means comprises a locking tongue integral with an extended portion of the lid component which engages a locking slot formed in the bottom of the tray component. The locking tongue comprises a tab element formed as a part of a flap foldably attached to an extension of the front wall of the lid. The locking slot comprises a cut out formed substantially along the fold line between the bottom wall and front wall of the tray.

8 Claims, 3 Drawing Sheets

CARTON WITH BOTTOM LOCK

BACKGROUND OF INVENTION

The present invention relates to a disposable carton for food products or the like and more particularly to a carton formed from lid and tray members which includes a bottom locking means between the lid and tray which is readily released.

The manufacture of disposable food cartons particularly for the fast food industry involves highly developed technology. Such cartons must be designed for maximum economy and utility with emphasis on ease of handling, filling and closing. Product identification, storage of unused cartons and integrity after being filled are also important. When such cartons are used for packaging hot foods, design considerations must be incorporated into the carton structure to provide a quick and easy means for loading and closing the carton lids to keep the foods hot and for retaining the lids in a closed condition until they are served. Conversely, the means for retaining the lids closed must be readily releasible by the consumer when the foods are to be consumed. Preferably the means for retaining the lids closed should be automatically engaged upon closing and released merely with the application of pressure to some portion of the carton.

There are many teachings in the prior art for locking the lids and trays of cartons together. However, in most cases, the closures cannot be automatically engaged, but require a separate mechanical action to align the locking elements together, or, one or more of the locking elements must be bent from its normal plane before it can be utilized. One example of an effective automatic lock for such cartons is disclosed in U.S. Pat. No. 4,516,718 owned by the present assignee. However, the locking means disclosed in the aforementioned patent is positive and not readily released.

SUMMARY OF INVENTION

The carton of the present invention comprises a pair of space defining members in the form of a lid and tray which may be releasibly locked together in their closed condition by an automatically engaged locking means. For this purpose, the lid component contains at least one locking tongue element connected to an extension of the lid front wall which normally lies in the same general plane as the front wall. Meanwhile, each tray component contains at least one locking slot, formed by a continuous cut line located in the tray front wall closely adjacent to a score line between the bottom panel and front wall which cooperates with the locking tongue element on the lid component. When the lid component and tray component are brought together to close the carton, the tongue element is automatically guided into the locking slot where the tongue element becomes releasibly secured in the locking slot. This action provides a temporary lock for the lid and tray components which is readily releasible merely by pressing inwardly on the front wall of the lid.

The tray and lid components are preferably integral and cut from a single blank of paperboard or the like. The side walls of the tray and lid are preferably oriented so as to taper outwardly from their respective bottom and top panels, and the tray has a lower front wall than its rear wall to enhance loading and provide easy access to the contents of the carton. In some instances, depending upon the shape and size of the carton, it may be desirable to provide the carton components with more than one locking means. The side walls of the lid component are designed to overlap the side walls of the tray component and the front wall of the lid is positioned inside the front wall of the tray. The locking elements of the carton disclosed herein operate from the inside to the outside. That is, the locking tongue is inserted into its locking slot from inside the tray so that the locking tongue extends outwardly of the front wall of the tray when the carton is closed.

This arrangement provides for easy release of the locking tongue when it is desired to open the carton. In addition, this arrangement in conjunction with the tapered side walls of the lid and tray provides an effective alignment action between the locking elements to achieve an automatic lock.

It is thus a general object of the present invention to provide a self locking food carton prepared from a single blank of paperboard or the like, and which is constructed so that when it is filled, closed and locked, the lid remains closed until it is releasibly opened.

A more specific object of the present invention is to provide an automatic locking means for a carton wherein the locking tonque is guided into its locking slot where the locking elements become automatically engaged with one another without additional manual adjustment or manipulation.

The foregoing statements are indicative in a general way of the nature and scope of the present invention. Other and more specific advantages will be apparent to those skilled in the art upon a full understanding of the construction and operation of the improved carton and its locking features disclosed more fully hereinafter.

DETAILED DESCRIPTION

Figure 1:
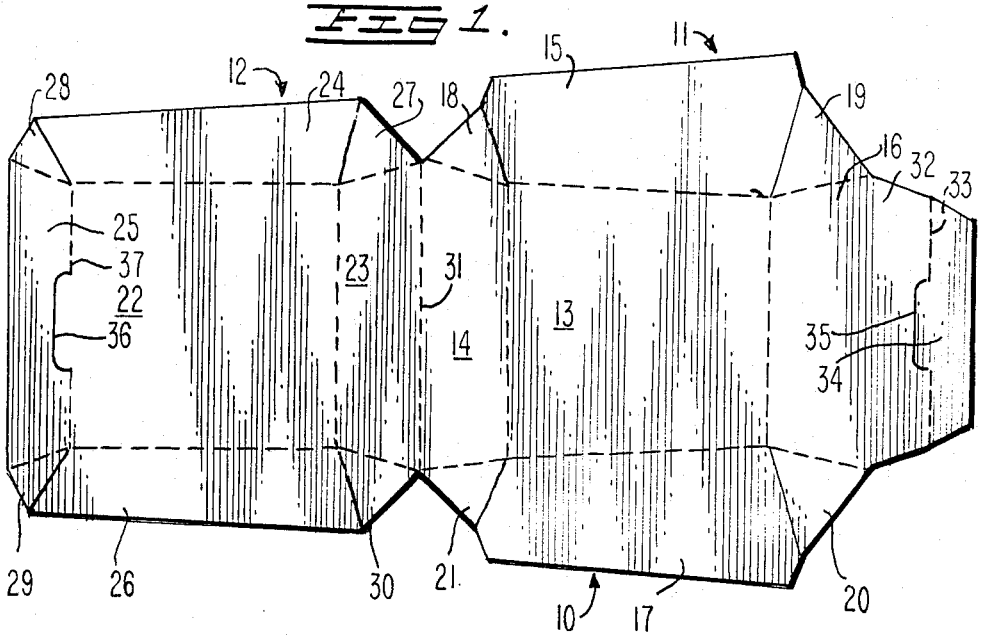
FIG. 1 is a plan view of a cut and scored paperboard blank for forming a carton according to the present invention.
Figure 4:
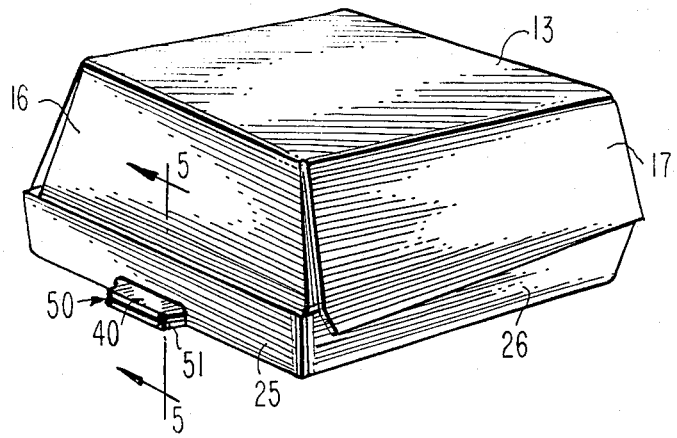
FIG. 4 illustrates the carton fully closed.

In one embodiment of the present invention, the carton is prepared from a single blank of paperboard 10 as shown in FIG. 1. Blank 10 is adapted to form a lid component 11 and a tray component 12, each in the shape of a truncated pyramid as shown in FIG. 4. The lid component 11 comprises a central top panel 13 of generally trapezoidal shape with opposed side walls 14, 15, 16 and 17 foldably connected thereto. Each side wall panel is in the general shape of a trapezoid with the minor base portion thereof connected to the central top panel 13 along fold lines. Each of the side walls also have glue tabs or the like 18, 19, 20 and 21 foldably attached thereto which may be connected to an adjacent side wall to produce a cover 11 in the shape of a truncated pyramid.

Figure 3:
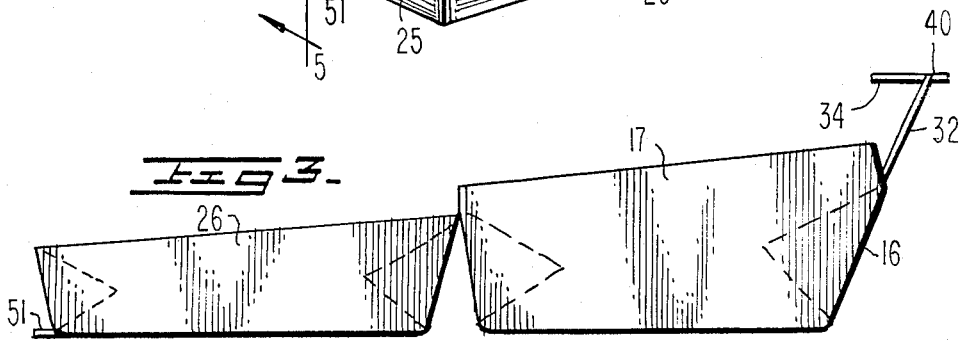
FIG. 3 is a side view of the carton of FIG. 2 ready to be closed.
Figure 5:
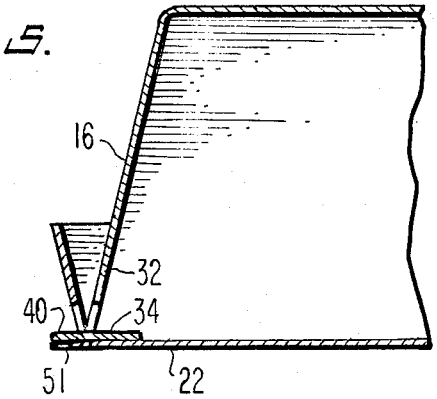
FIG. 5 is a partial cross section taken along the lines 5—5 of FIG. 4 showing details of the locking elements; and, FIG. 6 is a plan view of a second paperboard blank showing modifications for the locking tongue and slot.

In like fashion, the tray component 12 comprises a central bottom panel 22 of generally rectangular shape with opposed side walls 23, 24, 25 and 26, foldably connected thereto. Each tray component side wall is of generally trapezoidal shape with the minor base portion connected to the bottom panel 22 along fold lines. Each of the side walls also include glue tabs or the like 27, 28, 29 and 30, foldably attached to the ends thereof which may be adhered to adjacent side walls to produce a tray component in the general shape of a truncated pyramid. The lid component 11 is connected to the tray component 12 along a fold line 31 between the side walls 14, 23. Thus, the side walls 14, 23 form the rear walls of the carton, and side walls 16, 25 form the front walls of the carton. In actual practice, the blanks are partially set up and glued as shown in FIGS. 3 and 4 so they can be shipped in a nested condition as a joined tray and lid.

Figure 2:
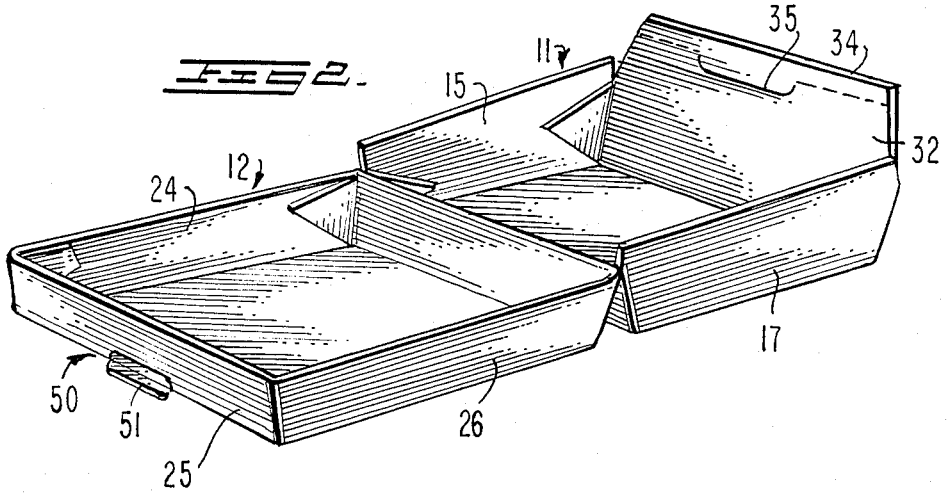
FIG. 2 is a perspective view showing the blank of FIG. 1 set up as a carton ready for loading.

A novel latching structure is provided for releasibly locking the lid 11 to the tray 12 when the carton is closed. As illustrated in FIGS. 1–5, a locking slot 50 is formed in the front wall of tray 12 by a cut line 36. The cut line preferably comprises a substantially straight centrally located segment offset from fold line 37 by an amount equal to about 3–5 mm with curved ends terminating at fold line 37. When the tray is set up as shown in FIG. 2, the portion of front wall 25 cut away by cut line 36 forms a lip 51 and opens the locking slot 50. Meanwhile, a locking tab 40 is formed in an extended portion 32 of front wall 16 of the lid element 11. The locking tab 40 is defined by a cut line 35 having a slightly curved central segment with drastically curved ends which terminate at fold line 33. The cut line 35 protrudes into the extension 32 of front wall 16 by an amount equal to about 3–5 mm. When the lid is prepared for closing as shown in FIG. 3, the portion of front wall extension 32 cut away by cut line 35 forms a locking tab 40 when the flap element 34 is folded inwardly along score line 33. When the lid is closed as shown in FIG. 4, the front wall extension 32 becomes positioned inside the front wall 25 of the tray component and urged downwardly until the flap element 34 rests on the bottom wall 22 of the tray. At this point, the locking tab 40 automatically becomes engaged in the slot 50 with tab 40 lying directly over the lip 51 of slot 50. When so engaged, the carton remains closed for vending. When it is desired to open the carton for consumption of the product, the front wall 16 is capable of deformation when pressure is applied by the consumers finger or thumb so that the locking tab 40 may be withdrawn from slot 50, thus permitting the carton to be opened.

Figure 6:
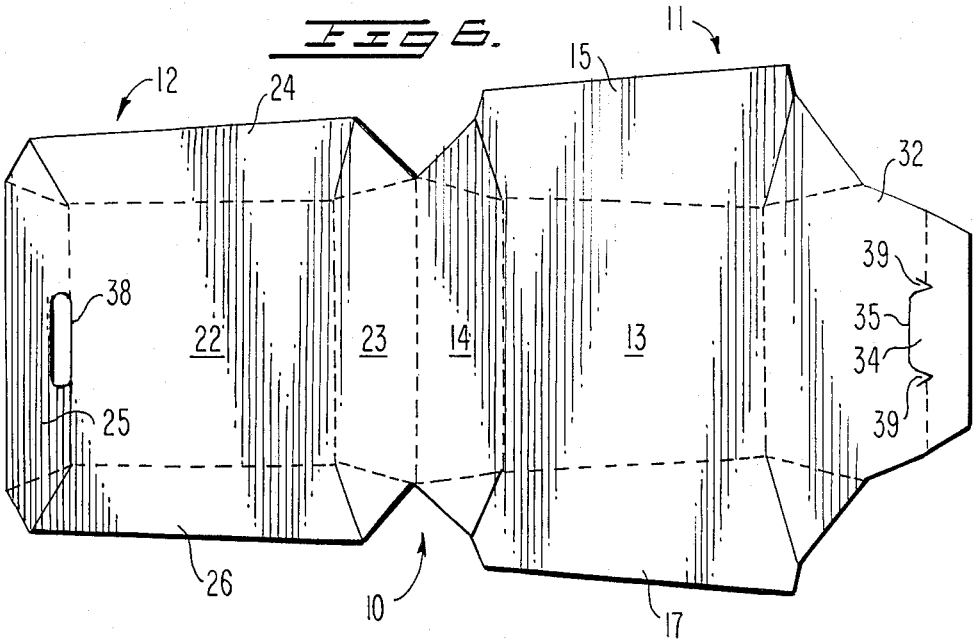

The modified blank structure shown in FIG. 6 employs a slightly different shape for the cut line 35 which forms the locking tongue, and an opening 38 in place of the cut line 36 for forming the locking slot. The cut line 35 shown in FIG. 6 includes a pair of shoulders 39 at each end which extend across the fold line 33 into the flap element 34. This alternative provides greater stiffness to the locking tongue and permits the use of a smaller flap element 34. Accordingly, the two embodiments disclosed herein illustrate a releasible friction lock located at the bottom of a carton for food or the like, The two carton components, i.e., lid and tray become locked together automatically when the lid is closed without the necessity of secondary manipulation. Conversely, the lock between the lid and tray is readily releasible when desired merely by applying pressure to the front wall of the lid to deform the front wall inwardly and deflect the locking tab from its slot. The locking elements, i.e. tab and slot, are easily exposed for use, and no deformation of either the locking tab or its cooperating slot is necessary to achieve the automatic locking function. Moreover, the locking elements do not present any interference with the normal nesting of the cartons prior to use. More than one locking means may be used on the same carton. For instance, where the carton is used to package as elongated product, two or more locking means could be provided in side-by-side relation. Thus, while only preferred embodiments of the invention have been fully described and illustrated in the accompanying drawings, it will be evident to those skilled in the art that changes and modifications may be made therein without departing from the spirit of the invention as set forth in the appended claims.

What is claimed is:

1. In a carton comprising a tray and lid, said tray having a rectangular bottom wall and trapezoidal shaped, upstanding side walls, a front wall and a rear wall, all with upper edges, said lid having a trapezoidal shaped top wall and trapezoidal shaped, downwardly extending side walls, a rear wall and a front wall all with lower edges, said rear walls being foldably connected together along a common fold line, the front wall of said tray being shorter than its rear wall and the front wall of said lid being longer than its rear wall so that the lower edges of the side walls of said lid extend outwardly and over the upper edges of the side walls of said tray, the improvement comprising, an extension integral with the front wall of said lid which extends inside the front wall of said tray, a flap element foldably connected along a fold line to the front wall extension which is adapted to lie on the bottom wall of said tray when the carton is closed, and a locking means between the tray and lid, said locking means including a tab element cut from the material of the front wall extension and a locking slot of substantially rectangular shape cut from the material of the tray front wall.

2. The carton of claim 1 wherein the flap element has a free leading edge and a trailing edge opposite said leading edge defined by its foldable connection to the front wall exension.

3. The carton of claim 2 wherein said locking tab extends from the trailing edge of said flap and is defined by a first cut line substantially centrally located from side-to-side in said front wall extension said tab in one position lying in the same plane as said front wall extension and in another position substantially perpendicular to said front wall extension with said tab inserted in said locking slot.

4. The carton of claim 3 wherein said first cut line has a greatly curved central segment with abruptly curved ends terminating at the fold line between said flap element and the front wall extension.

5. The carton of claim 3 wherein said first cut line has a greatly curved central segment located in said front wall with abruptly curved ends which extend across the fold line between said flap element and the front wall extension to form shoulder elements in said flap element.

6. The carton of claim 4 wherein said locking slot is defined by a second cut line substantially centrally located from side-to-side in the tray front wall and has a substantially straight central segment with curved ends which terminate at the fold line between said tray bottom wall and front wall.

7. The carton of claim 6 wherein the second cut line provides a lip member as an integral extension of said tray bottom wall in the same plane as said tray bottom wall when the slot is exposed.

8. The carton of claim 5 wherein said locking slot is defined by a second cut line which forms an elongated opening substantially centrally located from side-to-side in the tray front wall and lying adjacent to the fold line between said front wall and bottom wall.

* * * * *